United States Patent [19]

Beretta

[11] Patent Number: 4,625,443

[45] Date of Patent: Dec. 2, 1986

[54] SINGLE- OR DOUBLE-ACTION TRIPPING MECHANISM FOR FOUR-BARRELLED PISTOLS

[75] Inventor: Pier G. Beretta, Gardone V.T., Italy

[73] Assignee: Fabrica D'Armi P.Beretta S.p.A., Italy

[21] Appl. No.: 648,698

[22] Filed: Sep. 7, 1984

[30] Foreign Application Priority Data

Sep. 14, 1983 [IT] Italy ..... 5189 A/83

[51] Int. Cl.[4] ..... F41C 19/00

[52] U.S. Cl. ..... 42/42.03; 42/65; 42/69.01

[58] Field of Search ..... 42/42 B, 43, 65, 69 B, 42/41, 70 F; 89/147, 150, 154

[56] References Cited

U.S. PATENT DOCUMENTS 1,348,035 7/1920 Mossberg ..... 42/8
3,152,418 10/1964 Charron ..... 42/65
3,722,358 3/1973 Seecamp ..... 89/147
4,424,638 1/1984 Hillberg ..... 42/69 R

FOREIGN PATENT DOCUMENTS 453020 9/1936 United Kingdom ..... 42/70 F

*Primary Examiner*—Deborah L. Kyle
*Assistant Examiner*—Michael J. Carone
*Attorney, Agent, or Firm*—McGlew and Tuttle

[57] ABSTRACT

A four-barrelled pistol is disclosed which comprises a hammer having a rotating, click-action head for successively acting on firing pins corresponding to the four barrels. Particularly, a tripping mechanism is disclosed which controls the hammer of the pistol to allow either a single-action or double action operation. The pistol includes a mechanism for blocking and keeping the hammer in a cocked position when the trigger is at rest and for unblocking it when the trigger has been displaced, and mechanism for displacing the hammer into the cocked position and disengaging it immediately thereafter as a result of the displacement of the trigger.

5 Claims, 7 Drawing Figures

SINGLE- OR DOUBLE-ACTION TRIPPING MECHANISM FOR FOUR-BARRELLED PISTOLS

BACKGROUND OF THE INVENTION

The present invention relates, in general, to four-barrelled pistols which comprise a hammer or striking means with a rotating click-action head for successively acting on firing pins corresponding to the four barrels. Particularly, it relates to a tripping mechanism which controls the hammer of the pistol, so as to allow either a single or a double action of firing.

Pistols are already known with four fixed barrels which are capable of four firings, one for each barrel. Generally, these weapons comprise a hammer or striking means having a rotating, click-action head that successively positions itself and acts on the firing pins of the the four barrels. These pistols also comprise a tripping mechanism for the control of the hammers, when the trigger is actuated.

To place itself in the required position, the rotating head of the hammer is provided peripherically with notches, within which a rotation lever is engaged each time the hammer is displaced into a cocked position. In this manner, the head comes to act each time on the firing pin corresponding to the barrel within which the shell or cartridge is placed.

The four-barrelled pistols of the prior art, however, have a tripping mechanism which does not permit the weapon to operate in both single and double action, as is the case with pistols having a single barrel.

Incidentally, control of a single action in known pistols is obtained when the hammer, after a manual displacement to a cocked position, is engaged by acting on the trigger through a single traction action. The control for a double action, instead, is achieved by acting on the trigger both for the cocked phase and for the disengaged phase of the hammer. In fact, by means of a first and initial displacement of the trigger one obtains, through the employment of a connecting rod, the rotation of the hammer until the cocked position is reached or until the end of the rotation is reached; then, in immediate succession, and by virtue of the final displacement of the trigger, follows the disengagement of the hammer for the striking action.

The four-barrelled pistols of the prior art are, therefore, not suitable for effecting both operations mentioned above, because they are not designed to operate in both action, but either only in single action or only in double action.

SUMMARY OF THE INVENTION

It is therefore an object of the present invention to overcome the defects of the prior art by providing a tripping mechanism for four-barrelled pistols which is capable of operating in either single or double action, so as to enable the weapon to be employed in a more efficient, varied and correct manner;

It is another object of the invention to provide a tripping mechanism for four-barrelled pistols, which comprises means for blocking and holding the hammer in the cocked position, when the trigger is at rest, and for unblocking the hammer as a result of the displacement of the trigger, through a connecting rod, into the operative position, and means for moving the hammer into the cocked position and disengaging it as a result of the displacement of the trigger from one condition to the other, for the single-action or double action operation.

These and other objects of the invention will become apparent from a detailed description thereof and from the illustrative example of the tripping mechanism given hereinafter with reference to the accompanying drawings.

DETAILED DESCRIPTION OF THE INVENTION

Figure 5:
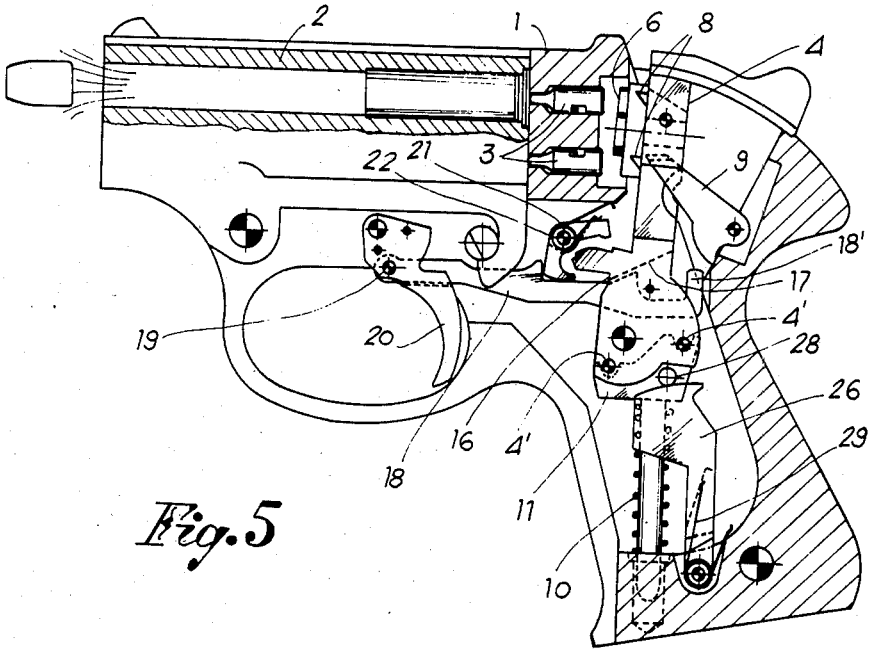
FIG. 5 shows the tripping mechanism with hammer disengaged in a double-action situation.
Figure 6:
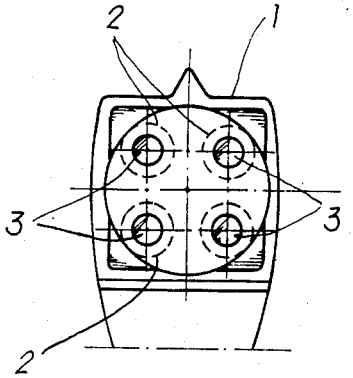
FIG. 6 is a view along arrows VI—VI of FIG. 2.

Referring now to the accompanying drawings, numeral 1 represents the muzzle of the pistol carrying, in a conventionally known manner, four fixed barrels 2, only one of which is shown in FIG. 5, four firing pins 3 positioned, for example, as the vertices in a square (see FIG. 6) and corresponding each to a barrel, and a hammer 4 acting successively on the firing pins 3.

Figure 7:
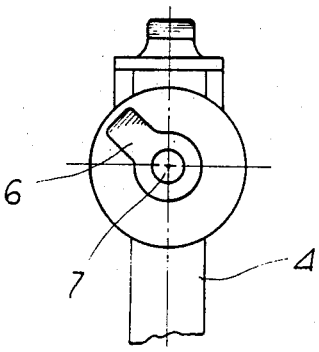
FIG. 7 is a frontal view of the hammer with rotating head.

The hammer 4 is mounted to the pistol frame on a rotation pin 5 and comprises frontally—see FIG. 7—a rotating striking head 6 capable of rotating click-wise about an axis 7, so as to position itself successively in juxtaposition with each firing pin 3. For its rotation, head 6 is provided with peripheral notches 8, in which is engaged, in known manner, a rotation lever 9 whenever the trigger is moved from the static condition shown in FIG. 1 to the cocked condition represented in FIGS. 2 and 4.

The hammer 4 is actuated underneath by a spring 10 by means of a forked cradle 11 on which the hammer 4 rests, due to its lateral protrusions 4', both in the cocked position and in the disengaged position.

In its central or middle section, the hammer 4 is provided with an appendix 12, facing forwardly and having on its upper surface, successively, a safety notch 13, an inclined surface 14 and a cocking tooth 15. Beneath the appendix 12 there is provided a frontal shoulder 16. Starting at the shoulder 16 there is provided a step 17, beneath which there is arranged the free extremity 18' of a connecting rod 18. The opposed extremity of the connecting rod 18 is instead attached at 19 to the trigger 20, so as to control the hammer during either a single-action or a double-action firing.

The safety notch 13 and the cocking tooth 15 of the appendix 12 cooperate with the extremity 21' of a trip rocker arm lever 21, the opposed extremity 21'' of which faces toward and cooperates with the connecting rod 18. The trip lever 21 is mounted on a rotation pin 22 and is actuated by a spring 23—see FIG. 1—so as to have its extremity 21' normally approaching the intermediate appendix 12 of the hammer.

The connecting rod 18, in turn, is provided with a disengaging tappet or nib 24 acting against the extremity 21'' of trip lever 21, so as to displace it angularly in opposition to spring 23. The rod 18 is also provided with an arming tappet or nib 25 to act against the shoulder 16 of the hammer 4, so as to have the pistol operate in double action. Finally, there is provided an inertial mass 26 pivoting pendularly on the frame at 27 and cooperating with a peg 28 positioned beside the forked cradle 11, so as to limit the rotational rebound of the hammer 4 due to the firing of the pistol. The inertial mass 26 is urged by a spring 29—see FIG. 1—which tends to keep this element 26 at rest. When in this position, this element is spaced from and, therefore, disengaged from the peg 28 of the cradle 11 cooperating with the hammer.

The tripping mechanism described hereabove allows the operation of the pistol in both single and double action. In the single-action operation, the hammer 4 is displaced manually from the rest position—see FIG. 1—to the cocked position—see FIG. 2—, where it is blocked by the extremity 21' of the trip lever 21, engaged with the cocking tooth 15 of appendix 12 of the hammer 4.

During such a displacement, the hammer 4 engages, by means of a transverse spine 30, the appendix 18' of the connecting rod 18, thus causing the approachment—partial—of the disengaging tappet or nib 24 to the extremity 21'' of the trip lever 21 and, concurrently, it causes the proper rotation of the trigger 20.

Figure 3:
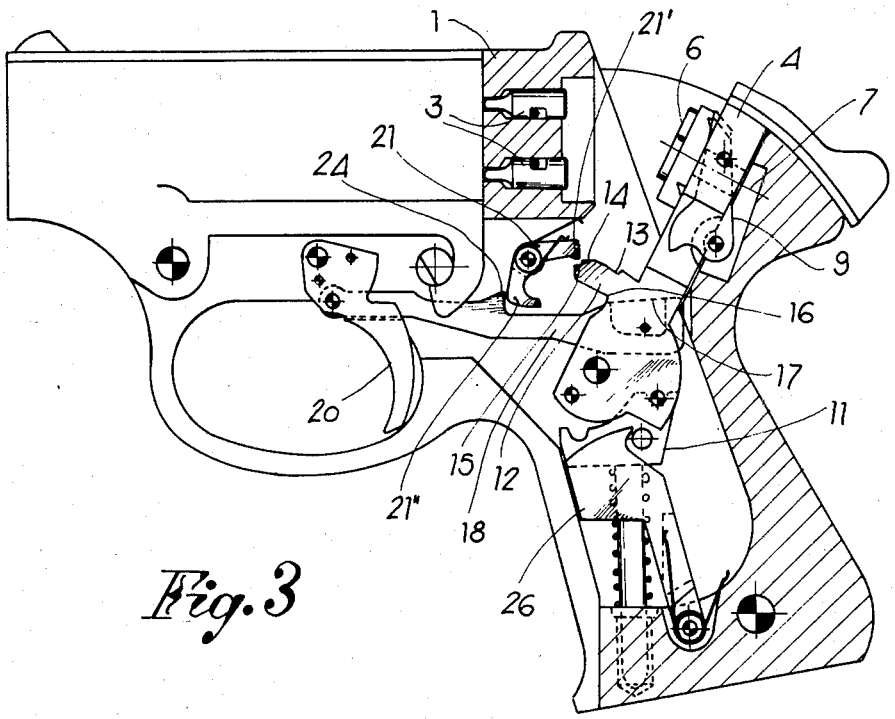
FIG. 3 shows the disengagement phase of the hammer in a single-action situation.

To disengage the hammer 4, it is necessary to act on the trigger 20 and to move it fully, as in FIG. 3. To the displacement of trigger 20 corresponds a backwards displacement of the rod 18, the nib 24 of which acts against the extremity 21''. The extremity 21'' is, therefore, rotated and determines the disengagement of the opposed extremity 21' of trip lever 21 from the cocking tooth 15, as shown in FIG. 3.

Thus, the hammer 4 is freed and, urged by its respective spring 10 by means of the cradle 11, is speedily displaced to strike a firing pin 3 and cause a shell to be fired in the barrel corresponding to this firing pin. At this point, the recoiling inertial forces and the forces acting thereagainst cause a displacement of the pendular element 26, which element limits the recoiling of the hammer and prevents its uncontrolled return into a cocked position. This action of element 26 is effected in cooperation with the peg 28 positioned beside the cradle 11 on which rests the hammer 4, as shown in FIG. 5. Besides the prevention of the recocking of the hammer, the rotation of the head 6 is also prevented and, consequently, the danger of an additional firing of the weapon. Once the counter-recoil action is terminated, the pendular element 26, urged by its own spring 29, returns to a rest position; while with the return of the trigger 20 to the original position, there occurs the disengagement of the trip lever 21 by the tappet or nib 24 of the connecting rod 18. Trip lever 21, urged by its spring 23, moves so as to engage with its extremity 21' the notch 13 on the appendix of the hammer 4 and block it in a safety positionor condition, because the hammer is prevented from approaching the firing pins.

Figure 1:
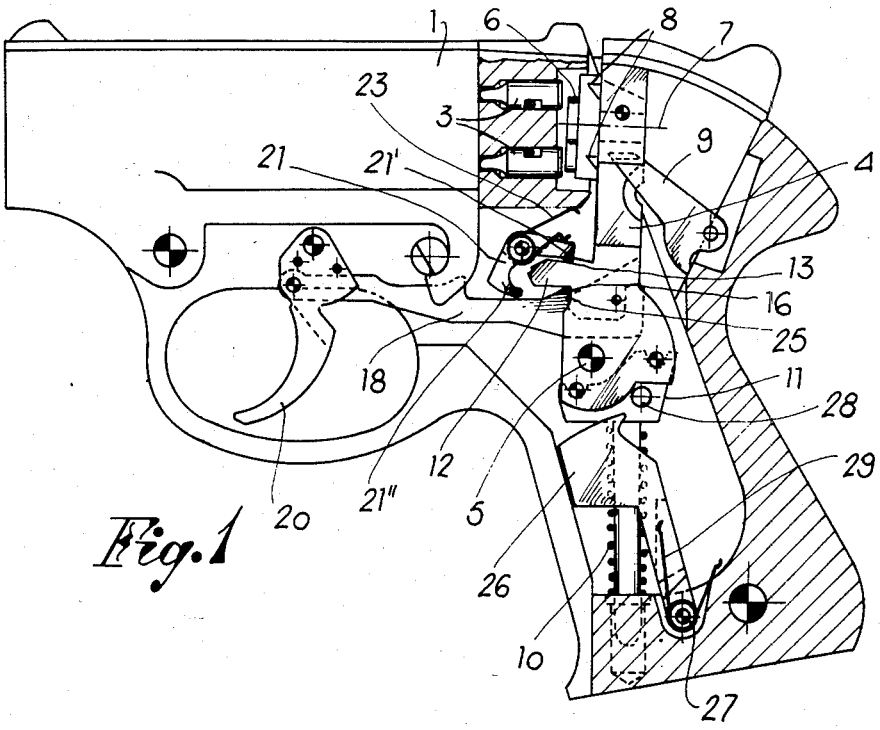
FIG. 1 shows a view of the tripping mechanism in a static position, that is with a disengaged hammer.
Figure 2:
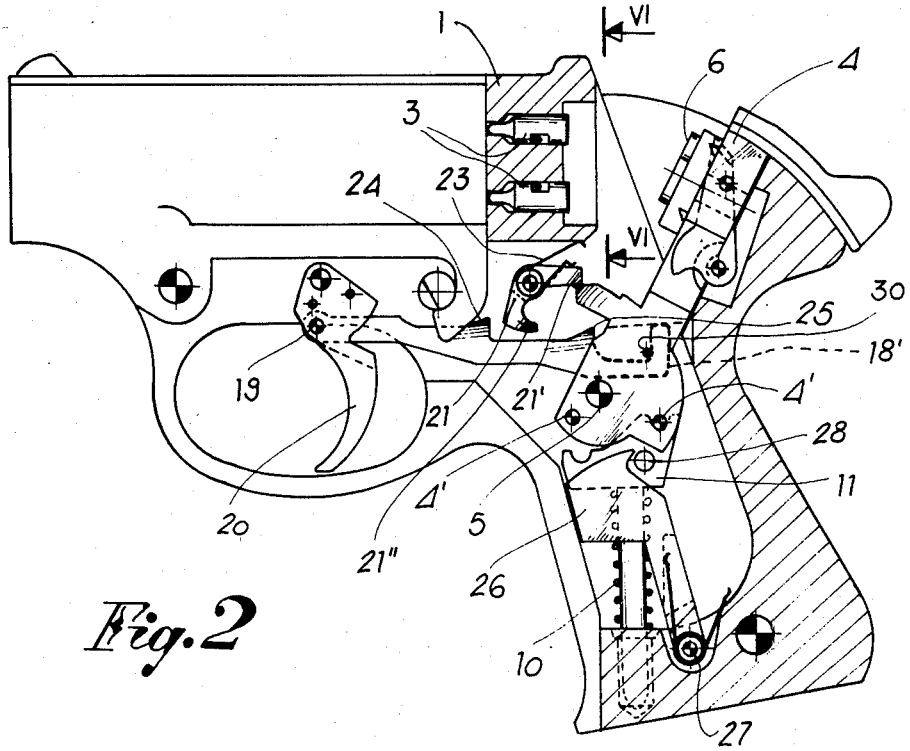
FIG. 2 shows the tripping mechanism with hammer blocked in cocked position for single-action control.
Figure 4:
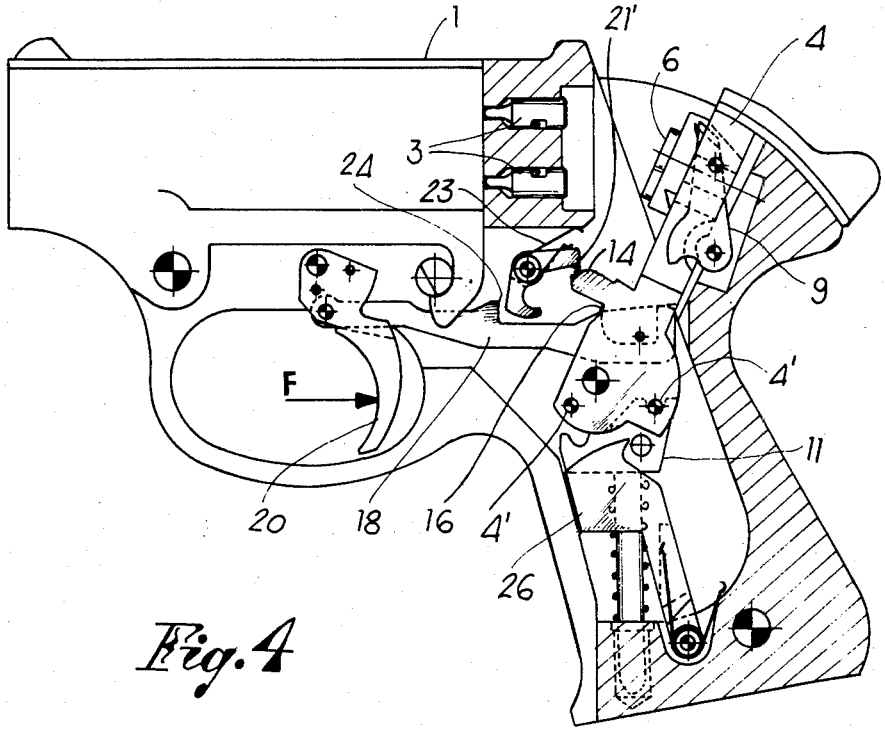
FIG. 4 shows the tripping mechanism with hammer in cocked position for double-action control.

For the operation of the pistol in double action, starting from the rest position shown in FIG. 1, it is sufficient to act on the trigger 20, moving it backwards, as indicated by arrow F in FIG. 4. To a first and initial displacement of the trigger 20 corresponds a backwards movement of the connecting rod 18, the arming tappet or nib 25 of which acts against the shoulder 16 of the hammer and determines the rotation thereof toward the cocking position.

Following this displacement of the hammer—see FIG. 4—the inclined surface 14 of the appendix 12 comes into contact with the extremity 21' of the trip lever 21 and moves it against and in opposition to the spring 23. In the last portion of displacement of the trigger 20, the disengaging tappet or nib 24 of the connecting rod 18 is acting against the extremity 21'' of the trip lever 21, so as to move it angularly and to lead away the other extremity 21' of the appendix 12 and, thus, prevent that the same extremity become engaged with the cocking tooth 15. Immediately thereafter, the arming tappet or nib 25 of the connecting rod 18 disengages from the shoulder 16 of the hammer, forced by the step 17 which rests on the posterior extremity 18' of the rod 18.

In this way, the hammer 4 is disengaged and can move, in order to effect its striking action against the firing pin. The condition of disengagement of the hammer in a double-action operation is represented in FIG. 3 and corresponds to the condition which occurs in the single-action operation, as shown in FIG. 5.

It is, therefore, evidently clear that, thanks to the tripping mechanism of the present invention, there exists the possibility of utilizing the weapon in two diverse modes, which was not possible heretofore.

What is claimed is:

1. A tripping mechanism for a pistol having four barrels, a firing pin for each barrel, a hammer mounted for movement between a cocked position away from the firing pin and a firing position toward the firing pins, a rotating head rotatably mounted to the hammer and rotatable into successive positions to strike successive firing pins when the hammer is moved into its firing position, head rotating means engaged with the head to rotate the head with movement of the hammer toward its cocked position, and a trigger mounted for movement between a rest position and a control position, said tripping mechanism comprising:

a connecting rod connected to the trigger for movement with movement of the trigger, said connecting rod having a disengaging tappet, an arming tappet and a portion spaced from the trigger and being adjacent to the hammer;

a trip lever having first and second extremities, said hammer having a cocking tooth, said trip lever being movable into a position with said first extremity thereof engaged with said cocking tooth when said hammer is in its cocked position, said second extremity being in a path of movement of said disengaging tappet, said connecting rod being movable to move said disengaging tappet against said second extremities to move said trip lever so as to disengage said first extremity from said cocking tooth, said connecting rod being moved by movement of the trigger from its rest position to its control position; and the hammer having a frontal shoulder engageable by said arming tappet of said connecting rod with movement of the trigger from its rest position to its control position, said hammer having a step extending from said shoulder and overlying said portion of said connecting rod which is spaced from the trigger, said portion of said connecting rod engaging against said step with further movement of said connecting rod to disengage said arming tappet from said frontal shoulder when the hammer has been moved to its cocked position by movement of said connecting rod, the continued movement of said connecting rod causing said disengaging tappet of said connecting rod to engage said extremity of said trip lever to move said first extremity of said trip lever away from said cocking tooth of the hammer.

2. A tripping mechanism, according to claim 1, including a spine extending from said hammer, said portion of said connecting rod engageable with said spine for moving the trigger from its rest position to its control position with movement of the hammer from its firing position to its cocked position.

3. A tripping mechanism according to claim 1, including a forked cradle movably mounted to the pistol and having lateral protrusion extending therefrom, said lateral protrusion being engaged with the hammer and a spring engaged with said forked cradle for urging the hammer toward its firing position.

4. A tripping mechanism according to claim 3, including an inertial element pendularly mounted for displacement to the pistol in relation to a counter-recoil force experienced by the pistol when a cartridge is fired in one of the barrels of the pistol, said forked cradle having at least one peg extending therefrom, and a further spring engaged with said inertial element for moving said inertial element away from said peg and in a direction opposite from the counter recoil force, said inertial element being mounted in the location to move adjacent said peg when said inertial element receives the counter recoil forces to hold said forked cradle in a position to limit displacement of the hammer during firing of the pistol.

5. A tripping mechanism according to claim 4, wherein the hammer includes an intermediate portion disposed between said forked cradle and the rotating head, said intermediate portion carrying an apex, said cocking tooth being defined on said apex and said apex having a safety notch spaced away from said cocking tooth and engageable with said first extremity of said trip lever to hold the rotating head away from the firing pin with said hammer near its firing position.

* * * * *